United States Patent [19]

Béguin

[11] 4,203,281

[45] May 20, 1980

[54] ASSEMBLY COMPRISING A TIMEPIECE PALLET ANCHOR AND ITS FRAME

[75] Inventor: Pierre Béguin, Rochefort, Switzerland

[73] Assignee: Portescap, La Chaux-de-Fonds, Switzerland

[21] Appl. No.: 898,522

[22] Filed: Apr. 20, 1978

[30] Foreign Application Priority Data

Apr. 21, 1977 [CH] Switzerland ..... 4940/77

[51] Int. Cl.[2] ..... G04B 15/00

[52] U.S. Cl. ..... 368/124; 74/1.5; 368/318

[58] Field of Search ..... 58/116 R, 23 D, 117, 58/121 R; 185/5, 31, 38; 74/1.5

[56] References Cited

U.S. PATENT DOCUMENTS

| | | | |
|---|---|---|---|
| 3,583,152 | 6/1971 | Lawson | 58/116 R |
| 3,731,480 | 5/1973 | Kurita | 58/116 R |

FOREIGN PATENT DOCUMENTS

| | | | |
|---|---|---|---|
| 2150063 | 9/1972 | Fed. Rep. of Germany . | |
| 161808 | 8/1933 | Switzerland . | |
| 169087 | 7/1934 | Switzerland . | |
| 541165 | 10/1973 | Switzerland . | |
| 3893/75 | 2/1977 | Switzerland | 58/116 R |

*Primary Examiner*—J. V. Truhe
*Assistant Examiner*—John B. Conklin
*Attorney, Agent, or Firm*—Cushman, Darby & Cushman

[57] ABSTRACT

An assembly comprising an escapement timepiece pallet anchor and its frame is disclosed, wherein the pallet anchor is in the form of one piece of plastics material having three arms and is rotatably mounted on the frame. The assembly comprises means for limiting the angle of rotation of the pallet anchor, which means include at least one auxiliary portion on the piece forming the pallet anchor and at least one part rigid with the frame disposed to cooperate with said auxiliary portion.

5 Claims, 13 Drawing Figures

ASSEMBLY COMPRISING A TIMEPIECE PALLET ANCHOR AND ITS FRAME

This invention relates to an assembly comprising an escapement timepiece pallet anchor and its frame, the pallet anchor being in the form of one piece of plastics material having three arms and being rotatably housed in the frame, the assembly comprising means for limiting the angle of rotation of the pallet anchor relative to the frame.

In the case of normal pallet anchors for timepieces, it is most often the lateral walls of the fork, or of the arm carrying the latter, which strike against fixed elements rigid with the frame in order to limit the angular displacement of the pallet anchor.

There are also metal pallet anchors each of which is provided with a pin perpendicular to its plane, moving within an aperture provided in the bridge. In one modification of this structure, a bent part of the pellet anchor replaces the pin. Certain pellet anchors are also known comprising stops which cooperate with the teeth of the escape wheel in order to limit the angle of rotation of the pallet anchor. Finally, there are pallet anchors comprising for example an additional arm designed to strike alternately against elements rigid with the frame of the timepiece.

All these known types of pallet anchor and the corresponding fixed parts of the frame require at least one delicate machining or assembly operation to construct sufficiently accurate stops, in mounting a pin on the pallet anchor, or in constructing the excape wheel with the required tolerances etc.

Among the pallet anchors constructed by moulding, there are those of solid form, such as of circular or triangular shape, of which the inertia of the unnecessary portions absorbs a considerable part of the energy to be transmitted.

The object of the present invention is to obviate these various drawbacks and to provide a pallet anchor-frame assembly in which the pallet anchor can be of a form which has a sufficiently low moment of inertia, and in which the means for limiting the angle of rotation of the pallet anchor can be constructed simply and at low cost, while enabling the manufacturing tolerances in mass production to be reduced, and the uniformity and general quality of the product to be increased.

According to the present invention there is provided an assembly comprising an escapement timepiece pallet anchor and its frame, the pallet anchor being in the form of one piece of plastics material having three arms and being rotatably housed in the frame, the assembly comprising means for limiting the angle of rotation of the pallet anchor relative to the frame, said means comprising at least one auxiliary portion on the piece forming the pallet anchor, and at least one fixed part rigid with the frame and disposed to cooperate with said auxiliary portion on the pallet anchor.

Said auxiliary portion on the pallet anchor can, for example, be in the form of an appendix on the pallet anchor body or be constituted by a cavity, a notch or an extension to one arm of the pallet anchor. In all cases, the pallet anchor can be constructed as one piece of plastics material by injection moulding, the auxiliary moulded portion not requiring any machining and therefore not influencing the cost of the pallet anchor.

The fixed elements of the frame which cooperate with the auxiliary portions on the pallet anchor can be constituted by notches in the bridge or in the plate of the timepiece, by lateral walls of the bridge or plate, or by at least one pin disposed in the bridge or plate. These parts can thus be obtained by simple punching or grinding carried out during an assembly operation. A suitable pin can be fixed by an automatic machine.

The design of the assembly according to the invention also enables the intensity of the impacts which occur in the escapement to be reduced, so reducing the operating noise.

The accompanying drawings show various embodiments of an assembly according to the invention by way of example.

FIGS. 6 and 7, 8 and 9, 10 and 11, 12 and 13 are plan and partly sectional views respectively of further embodiments of the assembly according to the invention.

Figure 1:
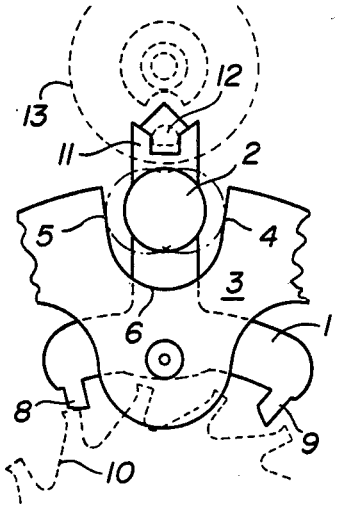
FIG. 1 is a plan view of a first embodiment of a pallet anchor and part of the frame cooperating therewith.
Figure 2:
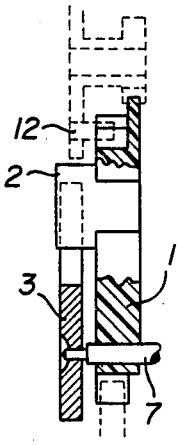
FIG. 2 is a section through the assembly of FIG 1.

In FIGS. 1 and 2, a pallet anchor 1 which is injection moulded in one piece from plastics material comprises three arms one of which has a fork 11 at its end, and the other two of which have at their ends pallets 8 and 9 respectively. These pallets cooperate with the teeth of an escape wheel 10. The balance wheel is represented diagrammatically and indicated by the reference numeral 13, the pin cooperating with the fork 11 being indicated by 12. The arm carrying the fork has an appendix 2 situated in a plane overlying that of the pallet anchor body, and is essentially in the form of a cylinder parallel to the pallet anchor arbor 7. The arbor 7 is inserted by forced driving into the pallet anchor body, and its end is housed in a bridge 3 forming part of the watch frame. The bridge 3 has a notch 6, of which the walls, and in particular the lateral walls 4 and 5, are parallel to the pallet anchor arbor. They cooperate, in the manner indicated by dotted lines in FIG. 1, with the appendix of the pallet anchor in order to limit its angle of rotation. The appendix 2 could equally be situated on one of the arms carrying the pallets and move within a suitable notch provided in the bridge. The appendix could also be situated on the other face of the pallet anchor, and cooperate with an aperture punched out of the frame plate.

Figure 3:
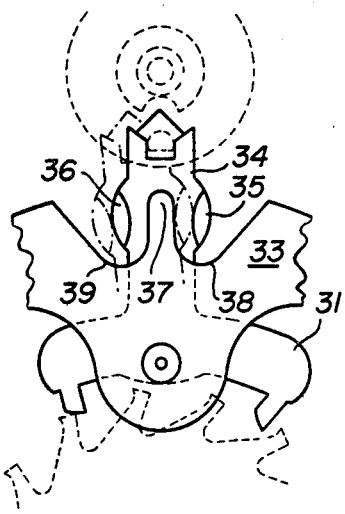
FIGS. 3 and 4 are views similar to those of FIGS. 1 and 2 respectively, of a further embodiment.
Figure 4:
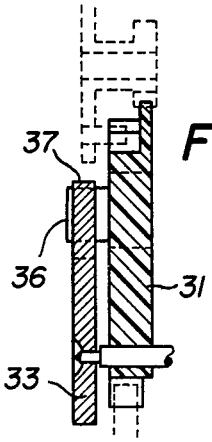

FIGS. 3 and 4 are plan and sectional views respectively of a further embodiment of the present assembly. The pallet anchor indicated by 31 has, on that arm carrying the fork, an enlargement 34 with two appendices of oblong section 35 and 36. In this case, the bridge 33 comprises two notches 38, 39, which receive the appendices 35 and 36 respectively, and form between them a finger 37. During operation, the appendices 35 and 36 strike alternately against the finger 37, i.e. the inner walls of the notches 38 and 39.

Figure 5:
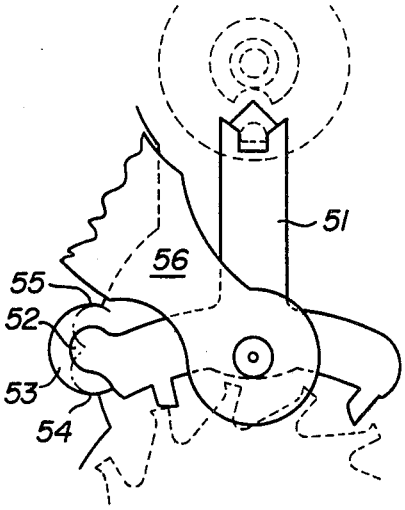
FIG. 5 is a plan view of a further embodiment.

FIG. 5 is a plan view of an embodiment in which the auxiliary portion of a pallet anchor 51 is formed by a lateral extension 52 of one of the arms carrying the pallets. This extension 52 comprises a part cylindrical wall parallel to the pallet anchor arbor, and cooperates with a cavity 53 provided in the watch plate. During operation, the portion 52 strikes against the parts 54, 55 of the cavity 53, which are likewise parallel to the pallet anchor arbor. The cavity 53 can be obtained either by pressing out a hole, or by machining a chamfered hole.

A similar cavity could obviously be provided in the bridge 56.

Figure 6:
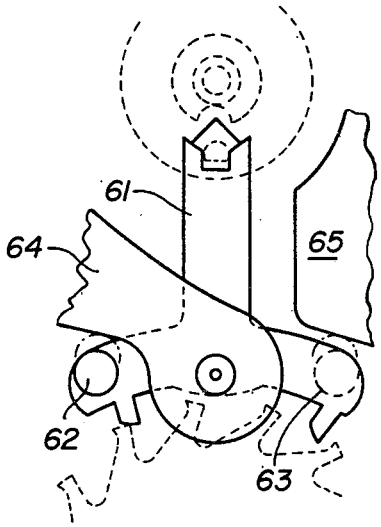
Figure 7:
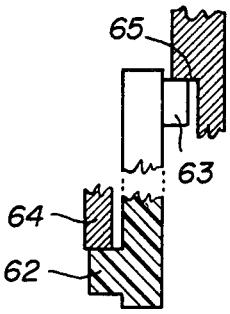

FIGS. 6 and 7 are a plan and partly sectional view respectively of an embodiment in which the two pallet arms of a pallet anchor 61 carry appendices 62 and 63 respectively. These appendices are for example of cylindrical form, and are located on one side and the other of the pallet anchor body, on the plane faces thereof. In the example shown, the appendix 62 cooperates with an edge of the bridge 64, and the appendix 63 strikes against a cut-out machined in the plate 65.

Figure 8:
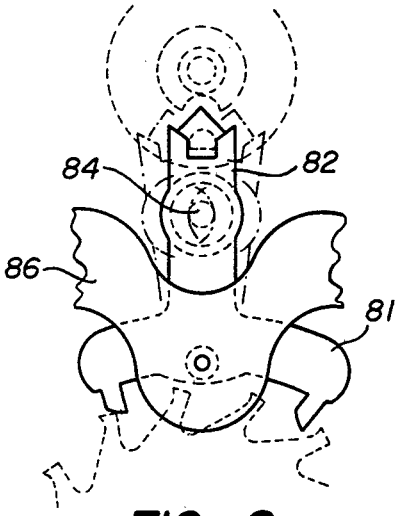
Figure 9:
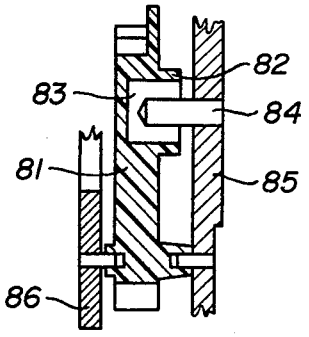

FIGS. 8 and 9 are plan and sectional views of a further embodiment. A pallet anchor 81, again comprising three arms and injection moulded in one piece, has an auxiliary portion 82 in the form of a hollow boss situated on the arm carrying the fork. The cavity 83 is cylindrical, and is parallel to the pallet anchor arbor. It cooperates with a pin 84 fixed into the watch plate 85. FIG. 9 shows the assembly of the pallet anchor between the plate 85 and bridge 86, the pallet anchor comprising a moulded bar with two seats which receive fixed pivots rigid with the frame.

Figure 11:
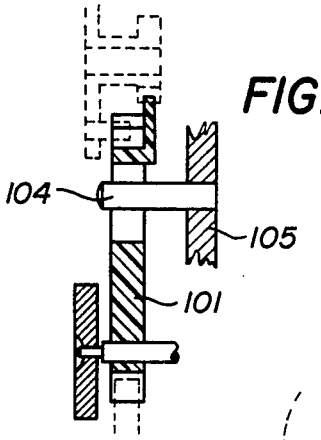
Figure 10:
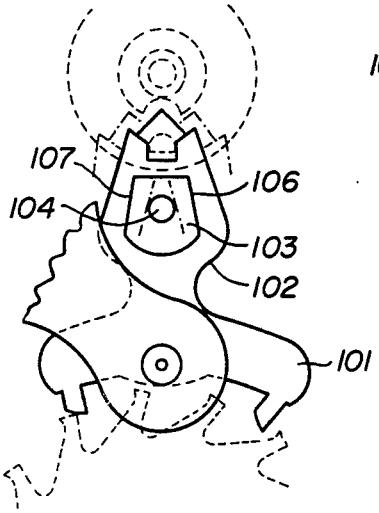
Figure 12:
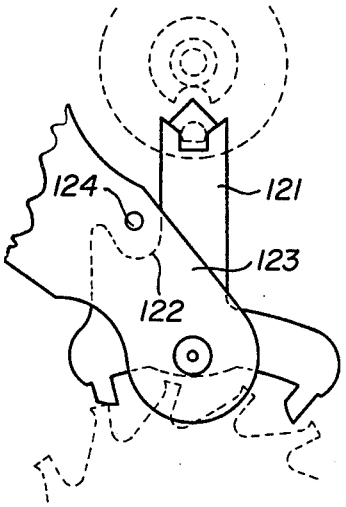
Figure 13:
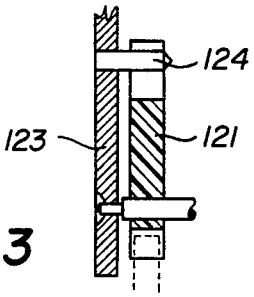

FIGS. 10 and 11 likewise show a modified embodiment of the assembly shown in FIGS. 8 and 9. In this embodiment, the auxiliary portion of a pallet anchor 101 is formed by an enlargement 102 in the plane of the fork arm, this enlargement having an aperture 103 traversing the pallet anchor. This auxiliary portion cooperates with a pin 104 which is fixed into the plate 105, which is parallel to the pallet anchor arbor. The lateral walls 106, 107 of the aperture in the pallet anchor are plane, and parallel to the rotational spindle of the pallet anchor, but their plane does not pass through said arbor. In this manner, a slight displacement of the free end of the pin in the plane containing the pallet anchor arbor enables the angle of rotation of the pallet anchor to be varied between the two limiting positions. IGS. 12 and 13 are a plan and sectional view respectively of an assembly comprising a pallet anchor 121 and a bridge part 123 in which the pallet anchor arbor is rotatably housed. In FIG. 12, the pallet anchor has a notch 122 situated in an intermediate part of the pallet anchor between the arm carrying the fork and one of the arms carrying the pallets. The walls of the notch 122 are parallel to the pallet anchor arbor and cooperate with a pin 124 parallel to said arbor and fixed into the bridge 123. The cooperation between the lateral walls of the notch and the pin determines tha angle of rotation of the pallet anchor, as previously.

Other embodiments of the present assembly can be envisaged either by combining elements similar to those heretofore described, or by a modification of these elements. In particular, the auxiliary portion of the pallet anchor can be formed by a special arm comprising either an appendix or a cavity cooperating with a suitable opposing element rigid with the frame. Alternatively, the pallets themselves could be extended in height above or below the wheel, and could strike against fixed elements of the frame.

The present assembly can be utilized in escapement timepieces of all sizes, including small watches, and allows the advantages mentioned initially to be obtained, in particular that of simplifying the manufacture of the pallet anchors and the corresponding parts of the frame, while providing the necessary accuracy and quality with extreme regularity in mass production.

I claim:

1. An assembly comprising an escapement timepiece pallet anchor and a frame, said pallet anchor being in the form of one piece of plastic material having a body and three arms extending from said body and being rotatably housed in said frame for rotation about an axis, the assembly further comprising means for limiting the angle of rotation of said pallet anchor relative to said frame, said means comprising two appendices to said pallet anchor situated in at least one space overlying the space occupied by said pallet anchor body, each of said appendices having at least one wall parallel to said axis, said means further comprising at least one fixed part integral with the frame disposed to cooperate with said appendices.

2. An assembly as claimed in claim 1, wherein said frame further comprises a timepiece bridge, wherein said appendices are situated on the same side of the pallet anchor and said walls are symmetrically arranged with respect to a plane passing through said axis, and wherein said fixed part integral with said frame is a tongue formed in said timepiece bridge, the lateral walls of said tongue being parallel to said axis.

3. An assembly as claimed in claim 1, wherein said frame further comprises a timepiece bridge, and wherein said appendices are situated on one side and the other of said pallet anchor body and wherein said fixed part integral with said frame comprises lateral walls of said timepiece bridge, parallel to said axis.

4. An assembly as claimed in claim 1, wherein said frame further comprises a timepiece plate, wherein said appendices are situated on the same side of the pallet anchor and said walls are symmetrically arranged with respect to a plane passing through said axis, and wherein said fixed part integral with said frame is a tongue formed in said timepiece plate, the lateral walls of said tongue being parallel to said axis.

5. An assembly as claimed in claim 1, wherein said frame further comprises a timepiece plate, and wherein said appendices are situated on one side and the other of said pallet anchor body and wherein said fixed part integral with same frame comprises lateral walls of said timepiece plate, parallel to said axis.

* * * * *